United States Patent [19]

Duffy

[11] Patent Number: 4,493,588

[45] Date of Patent: Jan. 15, 1985

[54] NON-CLOGGING EAVES TROUGH

[76] Inventor: Gifford R. Duffy, 2051 - 211th Ave., N.E., Redmond, Wash. 98052

[21] Appl. No.: 303,829

[22] Filed: Sep. 21, 1981

[51] Int. Cl.[3] ..... E02B 9/04; E04D 13/00

[52] U.S. Cl. ..... 405/119; 52/12

[58] Field of Search ..... 52/12; 405/119

[56] References Cited

U.S. PATENT DOCUMENTS

| | | | |
|---|---|---|---|
| 603,611 | 5/1898 | Nye | 52/12 |
| 891,405 | 6/1908 | Cassens | 52/12 X |
| 2,526,271 | 10/1950 | Probst | 52/12 X |
| 2,669,950 | 2/1954 | Bartholomew | 52/12 |
| 2,873,700 | 2/1959 | Heier | 52/12 |
| 3,950,951 | 4/1976 | Zukauskas | 52/12 X |

FOREIGN PATENT DOCUMENTS

| | | | |
|---|---|---|---|
| 507103 | 11/1954 | Canada | 52/12 |

*Primary Examiner*—Alfred C. Perham

*Attorney, Agent, or Firm*—James R. Haller

[57] ABSTRACT

A non-clogging eaves trough comprising an elongated sheet formed with a flange attachable to the roof of a building. The sheet includes a continuous smoothly curved portion extending outwardly, downwardly and then inwardly of the flange, and an upwardly open trough carried by and below the curved portion. The curved portion overhangs the trough, and a generally vertical screen extends between the trough and the curved portion and engages the latter at the sharp angle beneath the outermost reach of the curved portion so as to avoid diverting water from the smoothly curved portion.

9 Claims, 5 Drawing Figures

NON-CLOGGING EAVES TROUGH

TECHNICAL FIELD

The invention relates generally to the field of building construction, and more particularly to the design and construction of gutters and eaves troughs for residential housing.

BACKGROUND ART

Various devices have been provided for preventing sticks, twigs and leaves from collecting in and blocking the flow of rainwater through eaves troughs. Wire screening commonly serves as a protective cover for upwardly open eaves troughs. The screening must be periodically cleaned to prevent the accumulation of leaves and sticks thereon. Such accumulation not only is unsightly, but also can form a largely impervious cover over the upwardly open troughs, preventing rain water from entering the troughs. Further, the accumulation of leaves and other debris can hinder the free run-off of snow from roofs, ultimately leading to damage from ice formation under the roof shingles.

U.S. Pat. No. 603,611 (Nye) describes a gutter having a reversely curved strip of metal providing a smooth surface over which water from the roof would flow outwardly, downwardly and then back inwardly to be captured in a trough. This patent suggested that debris entrained in the water would fall from the generally vertical section of the smooth surface. In commenting upon the Nye invention, Bartholomew, U.S. Pat. No. 669,950, states that wet leaves, pieces of paper and other flexible objects that have great surface area would not fall from the smoothly curved surface of the Nye device, but rather would remain entrained in the water film and would be deposited in the trough portion of the device. To solve this problem, Bartholomew provided the curved surface with small, outwardly and downwardly oriented projections, Bartholomew's concept being that such projections would raise leaves, pieces of paper and the like from the flowing water film, permitting them to drop to the ground. A somewhat different design is shown in Cassens U.S. Pat. No. 891,405. The eaves trough described in this patent includes a generally flat, inclined upper wall, a trough beneath the upper wall, and a tight, generally S-shaped connection between the upper wall and the trough providing a curved surface over which rain water passes. The S-shaped portion includes uowardly open slots or orifices for straining debris from the rain water. A somewhat similar device is shown in Foster, U.S. Pat. No. 3,388,555, the latter patent showing an eaves trough having upwardly open, staggered slots for straining debris from the rain water.

In general, an upwardly open screen or other straining device carried by an eaves trough provides a place where leaves, sticks and other debris may collect to plug the straining device. Yet, with an eaves trough structure having a smooth, outer surface over which water is to run outwardly, downwardly and then inwardly toward a gutter, it is difficult to provide a straining device that on the one hand is not susceptible to becoming plugged with debris but on the other hand does not itself interrupt or divert the free flow of water along the smoothed, curved surface into the trough portion of the structure.

DISCLOSURE OF INVENTION

The present invention provides a non-clogging, substantially non-dripping eaves trough. The trough comprises an elongated sheet formed with a flange attachable to a building, a smoothly curved portion extending from the flange generally outwardly and downwardly and then downwardly and inwardly with respect to the vertical, a generally upwardly open trough section carried by and below the smoothly curved portion, and a generally vertical screen extending between the trough section and the smoothly curved portion and being so constructed and arranged as to avoid diverting water from the smoothly curved portion. The screen preferably makes a sharp angle of at least 30° with the smoothly curved portion, and desirably includes generally vertical wires contacting the smoothly curved portion, the wires having dimensions taken parallel to the length of the eaves trough of not greater than about one millimeter.

BEST MODE FOR CARRYING OUT THE INVENTION

Figure 1:
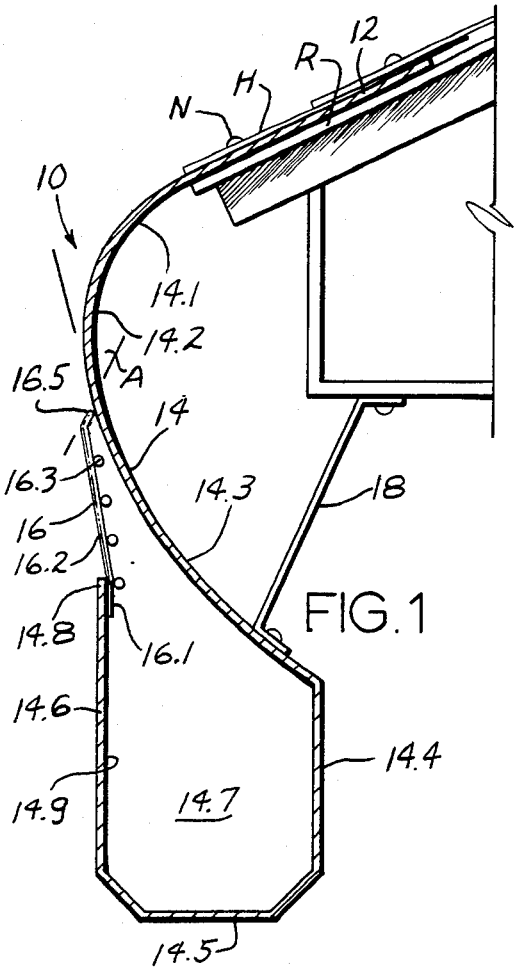
FIG. 1 is a cross-sectional view of an eaves trough of the invention, shown installed at the edge of a roof.
Figure 2:
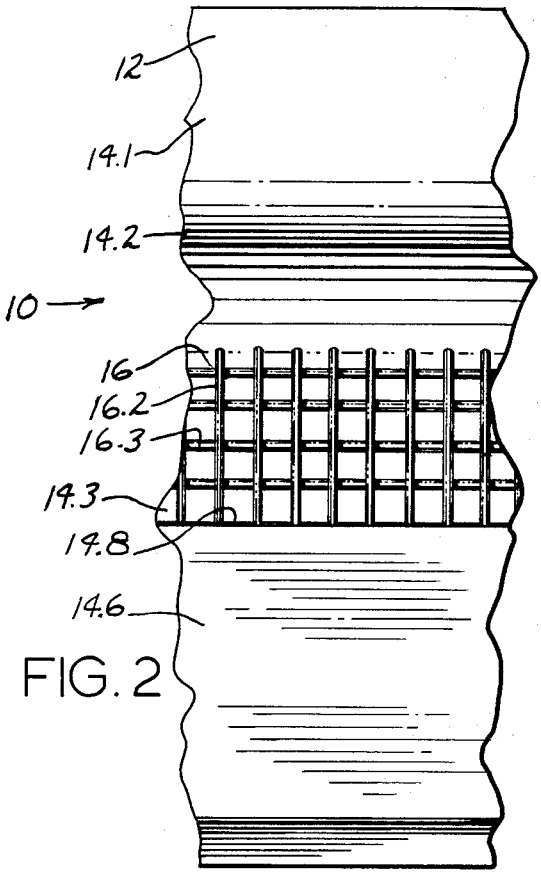
FIG. 2 is a broken-away, plan view of the eaves trough of FIG. 1.

Referring first to FIG. 1, the eaves trough of the invention is shown generally as 10 and is shown attached to the roof and adjacent structure "S" of a typical dwelling. The eaves trough of the invention includes a generally flat flange (12) that is attachable at the roof line of a building. As shown in FIG. 1, the flange is mounted atop the roof "R" of the dwelling beneath the shingles "H". Nails "N" or the like are typically driven through the shingles, the flange (12) and the roof to hold the shingles and flange in place. Extending smoothly outwardly from the flange is a portion (14) describing a smooth curve extending initially outwardly and downwardly of the flange as shown at (14.1), thence crossing the vertical as shown at (14.2) and thence extending generally downwardly and inwardly as shown at (14.3). The eaves trough then angles downwardly as shown at (14.4), outwardly as shown at (14.5) and then upwardly as shown at (14.6), the sections (14.4) and (14.6) defining generally vertical walls disposed on either side of the floor (14.5) and defining, with the floor, a generally V-shaped trough portion (14.7). The outer wall defined by the portion (14.6) terminates upwardly at an edge (14.8) spaced beneath the smoothly curved portion (14).

A screen (16) is attached at its lower end (16.1) to or adjacent the upper edge (14.8) of the trough portion, and preferably extends for a short distance downwardly along the inner surface (14.9) of the outer wall. The screen extends upwardly and into contact with the curved portion (14) of the eaves trough.

As shown in FIG. 1, the screen (16) extends upwardly and outwardly slightly from its attachment to the outer trough wall (14.9), and then bends upwardly and inwardly into contact with the smoothly curved portion (14), the screen making a reasonably sharp angle "A" of at least about 30° with the smoothly curved portion (14).

In use, rain water, which may entrain twigs, leaves and similar debris, flows smoothly down the curved portion (14) of the eaves trough of the invention, passing first generally outwardly and downwardly, and then downwardly and inwardly thereof, passing through the vertical and being deposited in the trough portion (14.7). Because of the reasonably sharp angle "A" between the screen (16) and the curved portion (14) of the eaves trough, substantially no water is diverted downwardly onto the screen; rather, substantially all of the rain water continues to follow the curved portion (14.3) into the trough portion (14.7). The leaves, twigs or other debris that do not automatically fall from the curved portion of the eaves trough as the same passes through the vertical come into contact with the screen (16) and are thus prevented from entering the trough portion (14.7). Because of the substantially vertical orientation of the screen (16), the debris that encounters the screen falls harmlessly to the ground.

Figure 3:
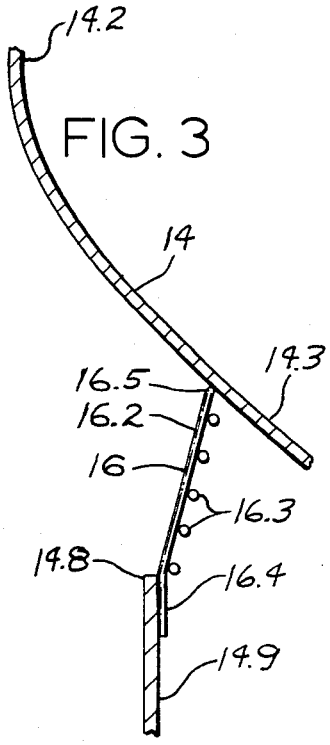
FIG. 3 is a broken-away, cross-sectional view showing a portion of an eaves trough of the invention.

The device of FIG. 3 is similar to that of FIG. 1 except that the screen (16) is inclined upwardly and inwardly toward the smoothly curved portion (14) of the eaves trough. The screen includes vertical wires (16.2) and transverse wires (16.3), the vertical wires being attached as by welding at their lower ends (16.4) to the inner surface of the outer wall (14.9). Desirably, the wires, the sheet forming the eaves trough, or both, are made of a material having at least some resilience or springiness such that the upper ends (16.5) of the vertical wires are resiliently pressed into contact with the outer surface of the smoothly curved portion (14).

Figure 4:
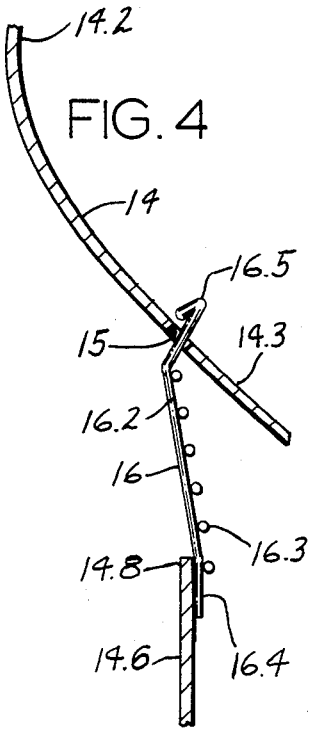
FIG. 4 is a view similar to that of FIG. 3 but showing a modification thereof.

The embodiment shown in FIG. 4 is similar to that shown in FIG. 1 except that the curved portion (14) is provided with a series of apertures (15) through its thickness, the apertures receiving the ends (16.5) of vertical wires of the screen (16). The upper end of the screen may be resiliently maintained in place, in the same manner as was described above in connection with FIG. 3, or may be provided with barbs at their ends (16.5), the barbs being readily inserted in, but removed only with difficulty from, the apertures (15) to hold the screen in place.

Figure 5:
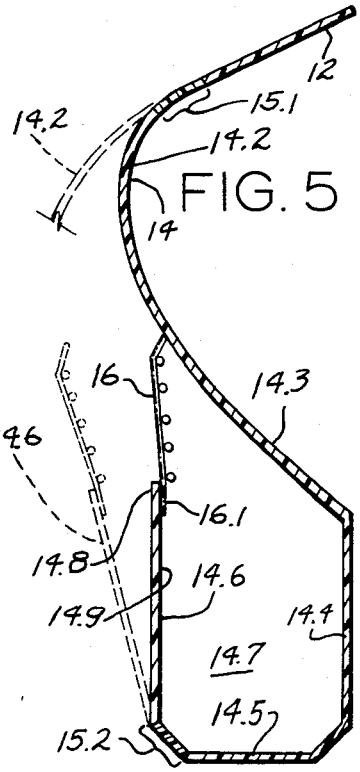
FIG. 5 is a cross-sectional view similar to that of FIG. 1 but showing another embodiment of the invention.

The device depicted in FIG. 5 preferably is made entirely of a plastic such as polyvinylchloride, and is made by common plastic extrusion techniques. In the embodiments described previously, the eaves trough of the invention may be made from appropriately bent sheets of metal such as steel or aluminum. The screen in the embodiment shown in FIG. 5 may be of plastic and may be adherred by using an adhesive, or otherwise affixed, to the upper end of the outer wall (14.9).

Preferably, the plastic eaves trough shown in FIG. 5 includes a portion (15.1) adjacent the flange (12) that is made from material of greater resiliency than the remainder of the eaves trough, thereby providing a hinge permitting the trough portion (14.7) to be moved inwardly and outwardly so that the correct and desired vertical orientation of the trough may be attained regardless of the pitch of the roof to which the flange (12) is attached. An alternate position for the eaves trough, in moving about the resilient section (15.1), is shown in phantom lines in the upper portion of FIG. 5. The hinge action thus described can be provided readily in the sheet metal versions of the invention by supplying a metal hinge or the like adjacent the flange (12). In the plastic version shown in FIG. 5, however, there are several ways in which the hinge section (15.1) may be readily manufactured. One method involves the use of a resilient plastic for forming the section (15.1), and extruded plastic articles having sections of different resiliency are now common in the art and have been termed "dual durometer" extrusions. For example, the resiliency of a polyvinylchloride plastic may be varied by known means, such as varying the amount of plasticizer that is employed. In another method, the hinge (15.1) may merely comprise a somewhat narrowed section of plastic; this is particularly effective if the eaves trough is to be made from a material such as polypropylene which has great resistance to failure by repeated bending. A similar section of comparatively resilient or thin-walled material may be formed in a section forming the trough portion (14.7), and is depicted in FIG. 5 as (15.2). The latter provision enables the outer wall (14.6) to be pulled outwardly, as shown in phantom lines in FIG. 5, permitting access to the trough (14.7).

The provision of a hinge such as that shown at (15.1) in FIG. 5 enables the trough portion (14.7) of the eaves trough to be pivoted inwardly or outwardly of the structure to which it is attached, it being generally desirable to position the walls (14.4) and (14.6) generally vertically and it being further preferable to position the screen (16) so that it is entirely beneath the smoothly curved portion (14) of the eaves trough. Once the correct position has been attained, other mounting means, such as the strap (18) shown in FIG. 1, can be employed to maintain the desired position of the eaves trough. It will be understood that when the trough is made out of thin-walled materials, such as thin-walled aluminum or steel sheeting, the sheeting itself will have sufficient bendability in the vicinity of the flange (12) as to permit the trough portion (14.7) to be bent into the desired orientation.

In the embodiments described above, it is desirable to employ, as the vertical wires, wires having dimensions in the direction of the eaves trough of not greater than about one millimeter. The wires preferably are round in cross-section, and also preferably have pointed or sharp-edged upper ends in contact with the smoothly curved portion.

While a preferred embodiment of the present invention has been described, it should be understood that various changes, adaptations and modifications may be made therein without departing from the spirit of the invention and the scope of the appended claims.

What is claimed is:

1. A non-clogging eaves trough comprising an elongated sheet formed with a flange attachable to a building, a continuous smoothly curved portion extending from the flange outwardly and downwardly and then downwardly and inwardly with respect to the vertical, a generally upwardly open trough section carried by and below the curved portion, the curved portion having an outermost reach extending outwardly of and overhanging the outermost extent of the trough section, and a generally vertical screen extending between the trough section and the smoothly curved portion and making a sharp angle with the latter portion, the screen engaging the smoothly curved portion below the outermost reach of the latter.

2. The eaves trough of claim 1 wherein the trough portion includes an upwardly extending outer wall having an upper, generally horizontal edge adjacent but spaced from and below the smoothly curved portion, and wherein the generally vertical screen has a lower edge attached to the upwardly extending wall internally of the generally horizontal edge of the latter.

3. The eaves trough of claim 1 wherein the screen includes a plurality of generally vertical wires, the gently rounded portion having apertures aligned with and receiving upper ends of said wires to anchor the screen to the gently rounded portion.

4. The eaves trough of claim 3 wherein the upper ends of the wires are barbed to permit easy insertion of such wire ends within the apertures but rendering withdrawal of the wires from the apertures difficult.

5. The eaves trough of claim 1 wherein the screen includes a plurality of substantially vertical wires having upper ends resiliently contacting the smoothly curved surface.

6. The eaves trough of claim 1 including hinge means parallel to its length and adjacent the flange for permitting the trough portion to be adjusted inwardly and outwardly into a desired orientation with respect to the vertical.

7. The eaves trough of claim 6 wherein the eaves trough comprises a single plastic extrusion of which a longitudinally extending portion adjacent the flange is characterized by comparatively great resiliency to define said hinge means.

8. The eaves trough of claim 6 wherein the eaves trough comprises a single extrusion of plastic of which a longitudinally extending portion thereof adjacent the flange is of reduced thickness to define said hinge means.

9. The eaves trough of claim 1 wherein said screen includes a plurality of generally vertically extending wires having dimensions parallel to the length of the eaves trough of not over about 1.0 mm.

* * * * *